US011274900B2

(12) United States Patent
Schmit et al.

(10) Patent No.: US 11,274,900 B2
(45) **Date of Patent: *Mar. 15, 2022**

(54) METHOD AND APPARATUS FOR RENDERING SAFE UNEXPLODED ORDNANCE

(71) Applicant: G.D.O., Elk River, MN (US)

(72) Inventors: Steve J Schmit, Orono, MN (US); Ryan M Smith, Minnetonka, MN (US); Paul L Miller, Harvest, AL (US); Nathan R Perkins, Maple Grove, MN (US)

(73) Assignee: GRADIENT TECHNOLOGY, Elk River, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/875,359

(22) Filed: May 15, 2020

(65) Prior Publication Data

US 2022/0049924 A1 Feb. 17, 2022

Related U.S. Application Data

(60) Provisional application No. 62/848,158, filed on May 15, 2019.

(51) Int. Cl.
*F41B 9/00* (2006.01)
*F42D 5/04* (2006.01)

(52) U.S. Cl.
CPC ..... *F41B 9/0087* (2013.01); *F41B 9/0078* (2013.01); *F42D 5/04* (2013.01)

(58) Field of Classification Search
CPC ..... F42B 33/06; F42B 33/062; F42B 33/065; F42B 33/067; F42D 5/04; F41B 9/0078; F41B 9/0087
See application file for complete search history.

(56) References Cited

U.S. PATENT DOCUMENTS 982,496 A * 1/1911 Hodge ..... F42B 33/06 86/49
2,512,597 A * 6/1950 Axtell ..... F42B 33/062 86/36
3,270,754 A * 9/1966 Moeller ..... F02K 9/24 134/110
3,312,231 A * 4/1967 Monroe ..... F42B 33/062 134/111
3,316,780 A * 5/1967 Herkner ..... F41A 15/22 81/3.05
3,348,426 A * 10/1967 Brown ..... F02K 9/24 74/500.5
3,440,096 A * 4/1969 Scott ..... F42B 33/062 134/24
4,046,055 A * 9/1977 McDanolds ..... F42B 33/06 86/50

(Continued)

*Primary Examiner* — Joshua E Freeman
(74) *Attorney, Agent, or Firm* — O'Connor & Company; Ryan P. O'Connor

(57) ABSTRACT

A system for rendering safe unexploded military ordnance items found on land by use of a portable apparatus employing entrainment waterjet technology. The portable apparatus includes a tool package containing a plurality of tools designed for accessing the interior of a unexploded ordnance item. The interior of the ordnance item is accessed, and its internal contents, which it typically an energetic material, is washed-out and recovered.

9 Claims, 8 Drawing Sheets

(56) References Cited

U.S. PATENT DOCUMENTS 5,210,368 A * 5/1993 Heller, Jr. ..... F41A 19/59 42/84
5,301,594 A * 4/1994 Argazzi ..... F42B 33/06 141/19
5,427,157 A * 6/1995 Nickens ..... B09B 3/0058 141/1
5,460,154 A * 10/1995 Mattern ..... B09B 3/0058 124/56
5,668,342 A * 9/1997 Discher ..... F42B 33/06 102/293
5,715,803 A * 2/1998 Mattern ..... B09B 3/0058 124/56
5,743,246 A * 4/1998 Mattern ..... B09B 3/0058 124/56
6,320,092 B1 * 11/2001 Vinnikov ..... F42B 33/062 134/22.13
6,802,237 B1 * 10/2004 Jones ..... B63G 7/02 102/402
7,775,146 B1 * 8/2010 Bitar ..... F41H 13/0043 89/1.13
8,887,609 B1 * 11/2014 Cherry ..... F42B 1/028 86/50
10,495,433 B1 * 12/2019 Langner ..... F42D 5/04
10,514,242 B1 * 12/2019 Yang ..... C25C 5/02
2002/0011172 A1 * 1/2002 Ito ..... F42B 33/06 102/293
2003/0010183 A1 * 1/2003 Reid ..... B26F 1/3806 86/50
2007/0132314 A1 * 6/2007 Fendt ..... F42B 33/06 307/10.1
2012/0000495 A1 * 1/2012 Schmit ..... F42B 33/10 134/58 R
2014/0238222 A1 * 8/2014 McKay ..... F42B 12/46 89/1.13
2016/0076865 A1 * 3/2016 Ram Porte ..... F42B 33/06 86/49
2018/0080734 A1 * 3/2018 Miller ..... B24C 1/045
2019/0003812 A1 * 1/2019 Heaton ..... F42B 33/067
2020/0096295 A1 * 3/2020 Yim ..... F41H 11/26
2020/0109934 A1 * 4/2020 Tong ..... F42B 33/062
2020/0408497 A1 * 12/2020 Schmit ..... F42B 33/062

* cited by examiner

METHOD AND APPARATUS FOR RENDERING SAFE UNEXPLODED ORDNANCE

FIELD OF THE INVENTION

The present invention relates to a method for rendering safe unexploded military ordnance items using entrainment waterjet technology. A circular plug is cut out of the casing of the ordnance item and its internal material is washed-out and recovered.

BACKGROUND OF THE INVENTION

According to US Environmental Protection Agency documents, unexploded ordnance (UXO), also sometimes referred to as unexploded "munitions", at some domestic inactive military training ranges pose an "imminent and substantial" risk to the public. The cleanup of such ordnance is estimated to cost billions of dollars. Bringing unexploded munitions, over land, to a facility that has the capacity to demilitarized them using waterjet technology would be too hazardous because of the potential for unintended detonation.

In the past, unexploded ordnance was rendered safe (demilitarized) by detonating them, or by cutting them open and recovering the internal material. Unfortunately, such methods are considered either too dangerous, or environmentally unfriendly and are no longer allowed. Abrasive entrainment waterjet technology has the potential of providing a safe and environmentally acceptable way of rendering safe unexploded military ordnance.

Therefore, there is need in the art for a portable system, that can be transported virtually anywhere on land to a location where one or more unexploded pieces of military ordnance is located.

SUMMARY OF THE INVENTION

A method for rendering safe an unexploded military ordnance item, which method comprises:

a) providing: i) a source of compressed air, ii) a source of hydraulic power, iii) a system for delivering abrasive material to a high pressure waterjet cutting head, iv) a source of electrical power, v) a source of fresh water, vi) a control system; and vii) an apparatus for deploying a tool package containing a plurality of tools for accessing and recovering internal material from said ordnance item;

b) locating an unexploded military ordnance item to render safe;

c) lowering a tool package into place above said targeted military ordnance item, which tool package is comprised of an inverted U-shaped structure containing a low profile cylindrical bases having a circular base plate having an annular through-hole of a size that will allow each tool of said tool package to reach through said through-hole to perform its intended function on a targeted military ordnance item under said through-hole, which circular base plate is supported from above by two vertical legs, 180 degrees apart, which legs, at their opposite ends, are secured at opposite ends of a cross beam, which tool package contains a plurality of tools radially positioned about a moveable turntable wherein the tools of said tool package are positioned in an array about said turntable, and which turntable also contains an annular through-hole for each tool, which though-holes are of substantially the same size as the through-hole in said circular base plate, which tools including: i) a high pressure waterjet cutting head capable of cutting a plug of casing out of said ordnance item; ii) a plug removal tool having a head capable of grabbing said plug of casing material and extracting it for disposal; iii) a waterjet head having at least one jet capable of delivering an effective jet of water at a pressure capable of washing out at least a portion of any internal material from the interior of said military ordnance item, which tool package, at its bottom contains a curved ordnance item holding structure having a radius of curvature substantially that of the targeted military ordnance item;

d) maneuvering said tool package over the targeted ordnance item so that the ordnance item holding device is directly over the targeted ordnance item;

e) lowering the tool package so that the ordnance item holding device makes contact with and secures said ordnance item;

f) rotating the turntable until the high-pressure abrasive waterjet cutting head tool is aligned with the annular through-hole in both the turntable and said circular base plate;

g) lowering the abrasive cutting head through said annular through-hole in said base plate to the surface of the casing of said targeted ordnance item, h) activating said abrasive waterjet cutting head and cutting a predetermined diameter plug out of the casing of said ordnance item;

i) deactivating said abrasive waterjet and raising the cutting head to its resting position;

j) rotating the turntable until the plug-removal tool is aligned with said annular through-hole of the circular base;

k) lowering said plug-removal tool through the annular through-hole and removing the plug, thereby exposing the internal material within the ordnance item casing;

l) raising the plug-removal tool to above said circular base;

m) rotating the turntable until the washout waterjet head is directly over the annular through-hole of the base plate; and n) lowering the waterjet washout head into the interior of said ordnance item and activating the washout waterjet and washing out and recovering at least a portion of the internal material from the interior of said ordnance item.

DETAILED DESCRIPTION OF THE INVENTION

Figure 1:
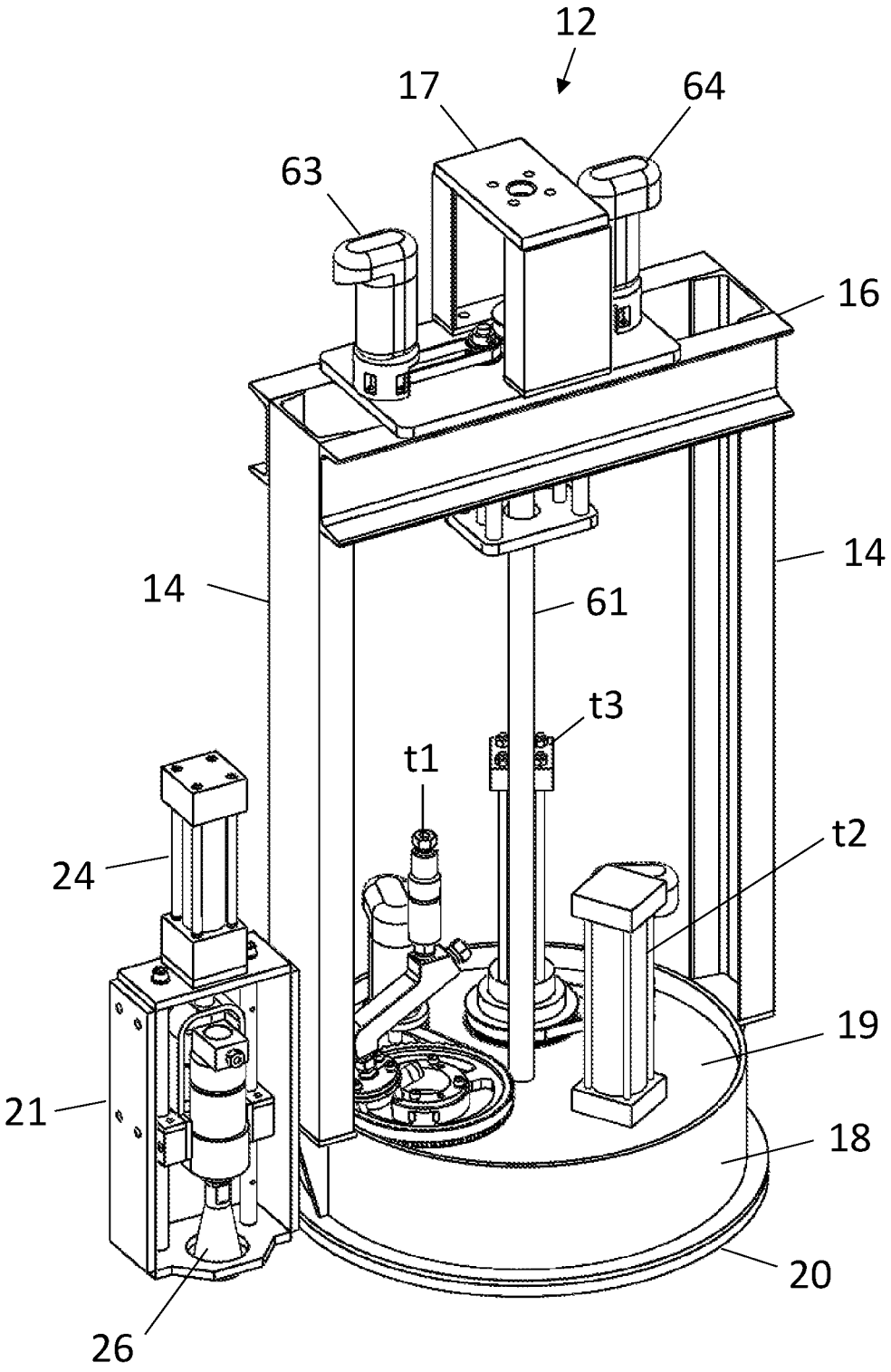
FIG. 1 hereof is an elevated perspective view of a preferred tool package of the present invention that will be used to accessing the interior of an unexploded military ordnance item and recovering its internal material.

It will be understood that the terms "ordnance item" and "military ordnance item" as used herein are used generically to mean any past or present military ordnance items that are typically dropped, or fired from a gun or cannon, although some may be self-propelled. Non-limiting examples of such military ordnance items include, projectiles, shells, bombs, missiles, rockets, as well as other munitions. For purposes of this invention the term "projectiles" is sometimes used for convenience to mean any unexploded military ordnance item that is capable of being rendered safe by the practice of the present invention. Such ordnance items are typically characterized as having a covering typically referred to as the casing which is most often comprised of a metallic material such as an iron-based material, a tin based material as well as a composite material. The casing encases a warfare material, non-limiting examples of which include energetic materials, chemical weapon materials, as well as bioweapon materials.

The key feature that may have to be changed to accommodate the difference size or shape of a particular ordnance item is the holding structure of the tool package that secures the ordnance item for processing. For example, bombs typically have a greater diameter than a conventional ordnance projectile shot from a gun or a cannon so such an item would require a holding device having a radius of curvature substantially the same as the bomb.

As previously stated, the instant invention is directed to the use of an abrasive waterjet cutting and accessing system comprising a tool package containing a plurality of tools capable of being useful for cutting into the casing of an unexploded military ordnance item and washing out and retrieving the internal material contained therein.

It is considered too dangerous to handle unexploded military ordnance, many of which are decades old and most likely in an advanced condition of decay. Thus, it is important that a totally unmanned system be used to render such item safe. All the systems and equipment of the present invention are remotely controlled.

The following services at needed in order to support the use of the tool package of the present invention:

a) A control system comprising the necessary hardware such as a PLC and other I/O used to control the complete system. The abrasive delivery system; the deployment system, and the tool package of the present invention require control of a variety of valves, sensors, instruments, and motors that interface with the control system. A human/machine interface, such as a computer, is used to control all equipment. In addition, some mechanical buttons, switches, and levers, will also be interfaced for additional control features.

b) A source of compressed air that is required for actuating valves and for delivering abrasive to the cutting head. An air compressor with ballast tank can be used for this purpose. The air compressor will require electrical power.

c) A source of hydraulic power is required for operating actuators and motors. An electric hydraulic pump is preferred for this purpose.

d) An abrasive delivery system. An abrasive media is used with the waterjet cutting head for cutting the casing of the targeted ordnance item. This abrasive is pneumatically conveyed to the cutting head (below water) via the use of an abrasive metering device that controls the abrasive flow rate. The abrasive originates from a pressurized abrasive hopper that keeps the abrasive metering device full of abrasive. As a result, both air and abrasive are sent to the cutting head. The abrasive metering device is controlled by the control system.

e) A source of electrical power is provided which is required by the control system, air compressor, hydraulic unit, deployment system, water source, high-pressure pump, and tool package. A fuel-supplied generator can be used to provide the required electrical power.

f) A source of clean water is provided, which is required by the high-pressure pump for the cleaning head, cutting head, and washout head. In addition, water is required for cooling the high-pressure pump. A tank of water can be used for this purpose or a reverse osmosis (RO) unit used to generate clean water as required. It will be understood that sea water, although not preferred, can also used. Part of this fresh water system will be an appropriately sized water storage tank located above water. Fresh process water can also be stored underwater in a suitable storage device g) A high-pressure water-jet pump for generating high-pressure water for the cleaning head, cutting head, and washout head. A variety of pump options exist that are either directly driven, such as a reciprocating pump, or a hydraulically driven pump, such as an intensifier pump. The pump generates the desired flow rate (1-5 gpm) of high-pressure (~60 ksi) of water.

h) A deployment system including equipment to lower the tool package above the targeted ordnance item. The deployment system includes a hoist as well as the equipment necessary to properly handle all flexible lines attached to the tool package. These lines include the abrasive feed line, air lines, hydraulic lines, high-pressure water lines, control cables, etc.

The tool package is described in more detail in FIGS. 1-8 hereof. The capture system (not shown) comprises at least one pump used to pull water from the surroundings and through the volume created between the turntable and the sealing device (ordnance item holding device) secured to the targeted ordnance item to be rendered safe. Such pumps provide a continuous flush of water through this volume and generates a slurry during cutting and washout. The discharge of such pumps is directed to a collection tank.

FIG. 1 hereof is an elevated perspective view a tool package 12 of the present invention, which will be positioned over an unexploded military ordnance item, which will be sometimes referred to herein as the targeted ordnance item. Tool package 12 is preferably comprised of an inverted U-shaped frame comprised of two vertical legs 14 which at one end are secured to cross-member 16 and which at the other end are secured to cylindrical base 18, which contains a cylindrical base plate 20. Cross-member 16 also preferably includes, at its center, bracket 17 for attaching to a tool package positioning system not shown in this figure. The cylindrical base contains an annular through-hole (not shown in this Figure) of a size suitable to allow each tool of the tool package to be able to reach through the through-hole to the targeted ordnance item to be able to perform its intended function. There is also provided a waterjet cleaning apparatus 21 secured to the lower section of the tool package 12. Also shown in this figure is cleaning apparatus 21 which includes a high-pressure head 26 which is preferably raised and lowered by hydraulic means 24.

Cleaning apparatus 21 provides a clean surface on the casing of the ordnance item, if needed, to enhance accessing (cutting) and capturing material generated during cutting as well as capturing washed-out internal material inside the ordnance. The tool package is maneuvered over the targeted ordnance item such that the cleaning head is positioned over one end, typically the fuse, or blunt, end of the ordnance item. The cleaning head is individually lowered to a predetermined cleaning distance above the targeted ordnance item and the entire tool package is moved, in a predetermined pattern, down the length of the ordnance item thereby removing at least of portion, preferably all, of any contaminant, including bioencrustacean growth that may have formed on the ordnance item. Also, part of the cleaning apparatus is a high-pressure water-jet cone nozzle 26 to help generate the high-velocity spray capable of removing contaminants. When cleaning is complete, the high-pressure water is turned off, the cleaning head is retracted, and the tool package moved over and lowered onto said targeted ordnance item in such a way that the ordnance item holding means is mated with the targeted ordnance item.

Also shown in this FIG. 1 is a plurality of tools t1, t2 and t3 mounted on turntable 19 in an array around the turntable. Preferably the tools are mounted about 120° apart. Each tool is also associated with an annular through-hole (not shown in this figure) on the turntable to enable the tool to be lowered through both its associated annular through-hole on the turntable and through the annular through-hole in said base plate. For example, when a given tool is needed it's associated through-hole is positioned over the through-hole in the base plate over the ordnance item holding device.

FIG. 1 hereof also illustrates spindle 61 connected at one end to the center of turntable 19 and at its other end to the center of cross-member 16 where it is rotationally connected to servo motor 63 that provides rotational movement to spindle 61 and turntable 19 and to servo motor 64 which is used to raise and lower the turntable. It is be understood that the turntable can be indexed so that it can made to rotate and stop in order of the use of the tools. For example, the first tool to be used is the cutting head t1, followed by the plug removal tool t2, followed by the washout tool t3, which are better shown in FIG. 2 hereof. Indexing will allow each tool to stop wherein the through-hole on the turntable is located precisely above the through-hole on the base plate.

Figure 2:
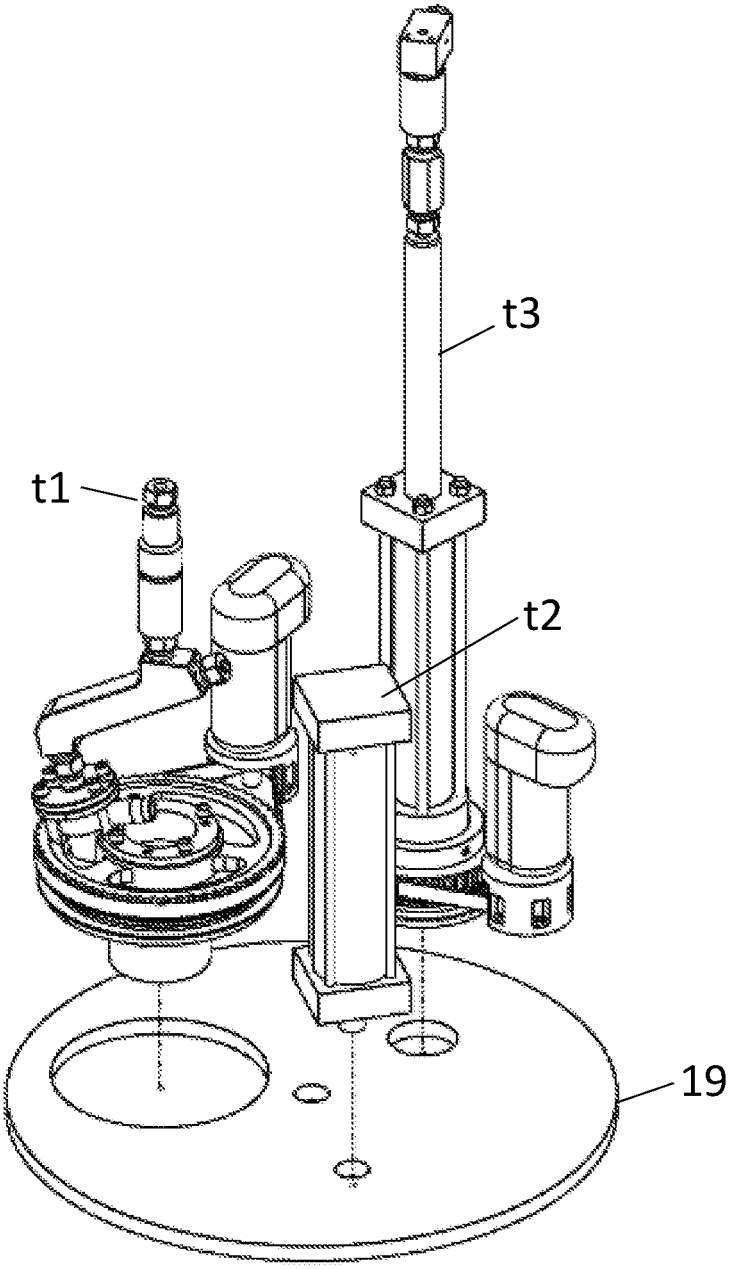
FIG. 2 hereof is a view of the turntable containing the three tools and their associated through-holes of the present invention.

FIG. 2 hereof is a clearer representation of the required tools of the present invention of turntable 19 and tools t1, t2, and t3 as well as their associated holes.

Figure 3:
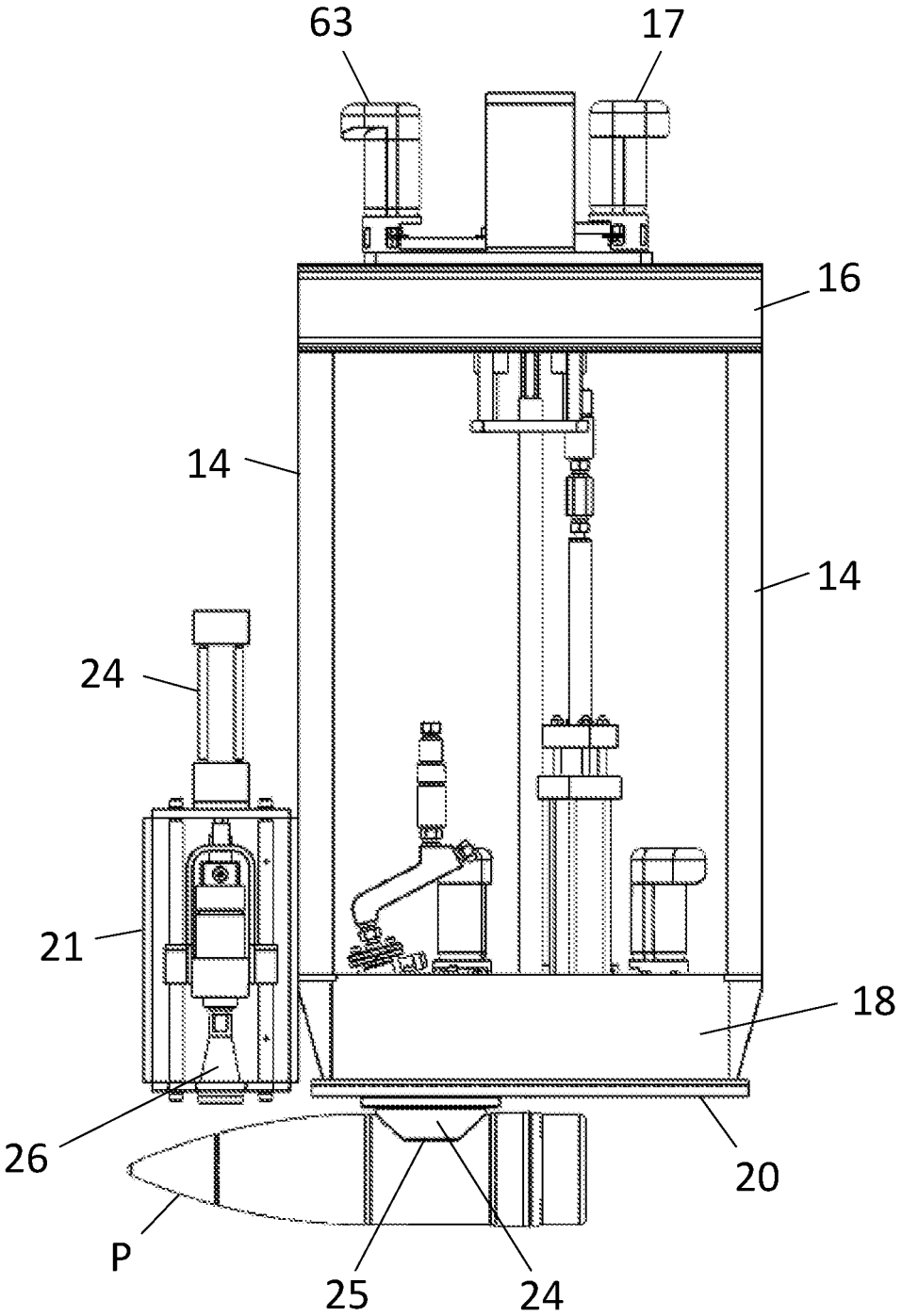
FIG. 3 hereof is a side view of a preferred tool package of the present invention which is secured to a targeted unexploded military ordnance item for being rendered safe.

FIG. 3 hereof is a side view of the tool package 12 of the present invention secured with projection holding device 24 which is contoured having a radius of curvature substantially the same as the radius of curvature of the targeted ordnance item P to be rendered safe. Holding device 24 will preferably have, on its surface that will come into contact with the targeted ordnance item, a sealing material 25 so that a substantially water-tight seal is formed between the holding device and the targeted ordnance item.

Figure 4:
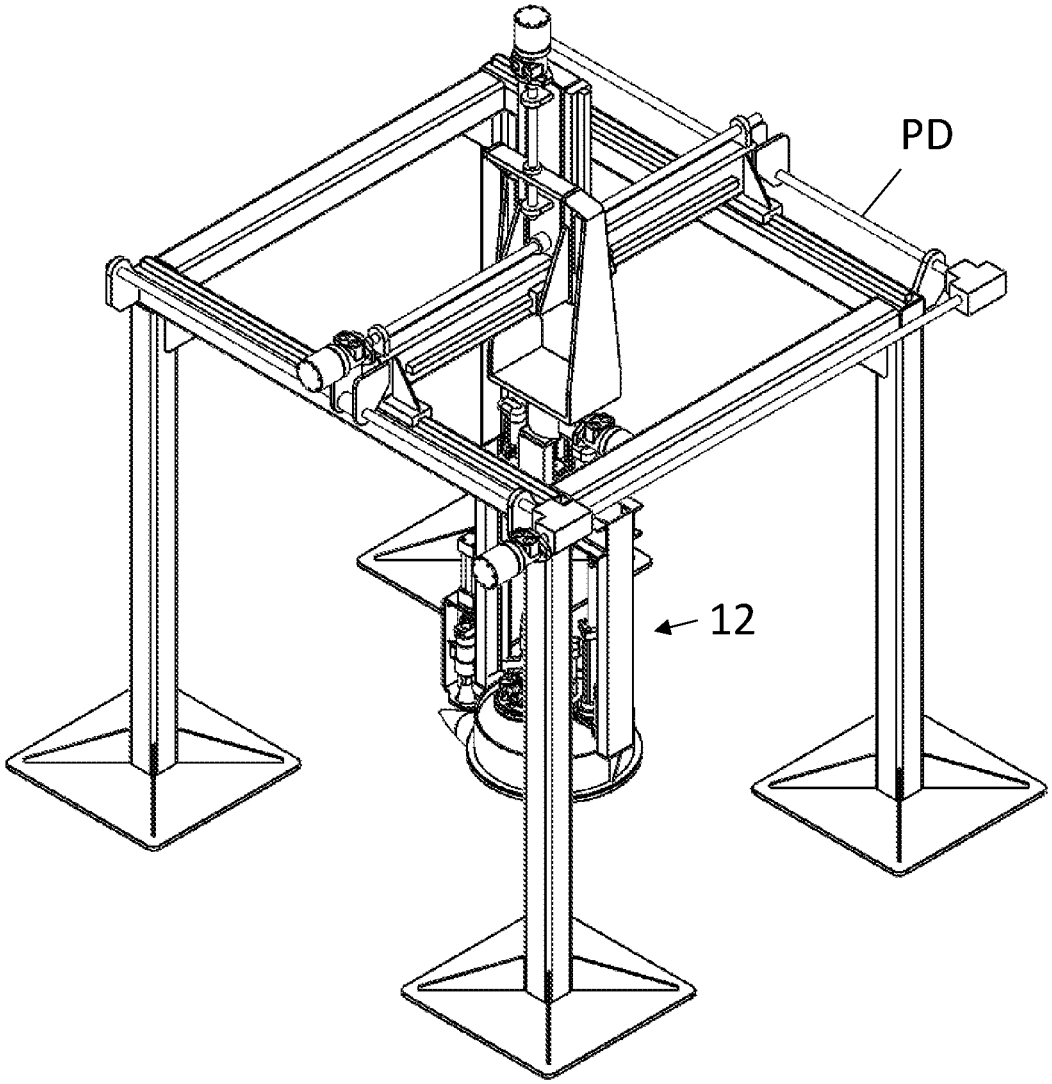
FIG. 4 hereof is an elevated view of tool package of the present invention positioned on a gantry structure that is used for positioning and securing the tool package of the present invention to a targeted ordnance item.

FIG. 4 hereof is an illustration showing a gantry as a first positioning device PD. The gantry provides motors that make it capable to move tool package 12 in all three planes, x, y, and z. Although not shown, there will also be required a second positioning device, not shown, that will be capable of positioning the entire system, including the first positioning device, over the targeted ordnance item.

Figure 5:
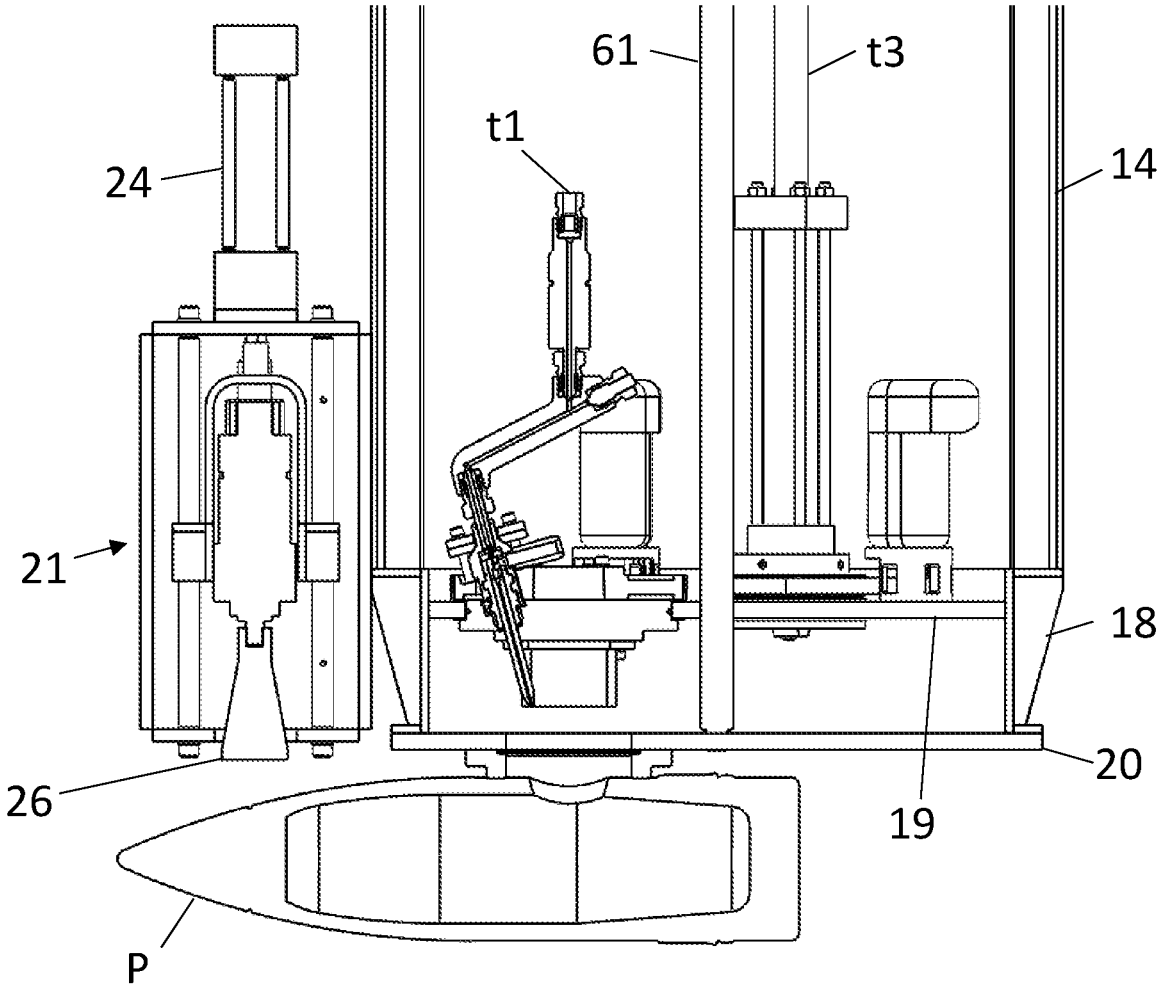
FIG. 5 hereof is view of tool package of the present invention, cut along its vertical middle plane, wherein said tool package is secured to a targeted ordnance item and the waterjet cutting tool is lowered through the two through-holes and at the ordnance item casing to being cutting out a plug of said casing.

FIG. 5 hereof is a view of the lower section of the tool package of the present invention, but showing in more detail waterjet cutting tool t1. It is preferred that the cutting tool be an articulated mechanism, particularly because it is preferred that a plug of the casing be cut at an inward angle to prevent the plug from falling into the interior of said ordnance item. During cutting, turntable 19 is lowered so the cutting tip is close to the surface to be cut. In addition, the cutting head is slowly rotated (0.01 to 5 rpm) to cut a hole in the target item.

Figure 6:
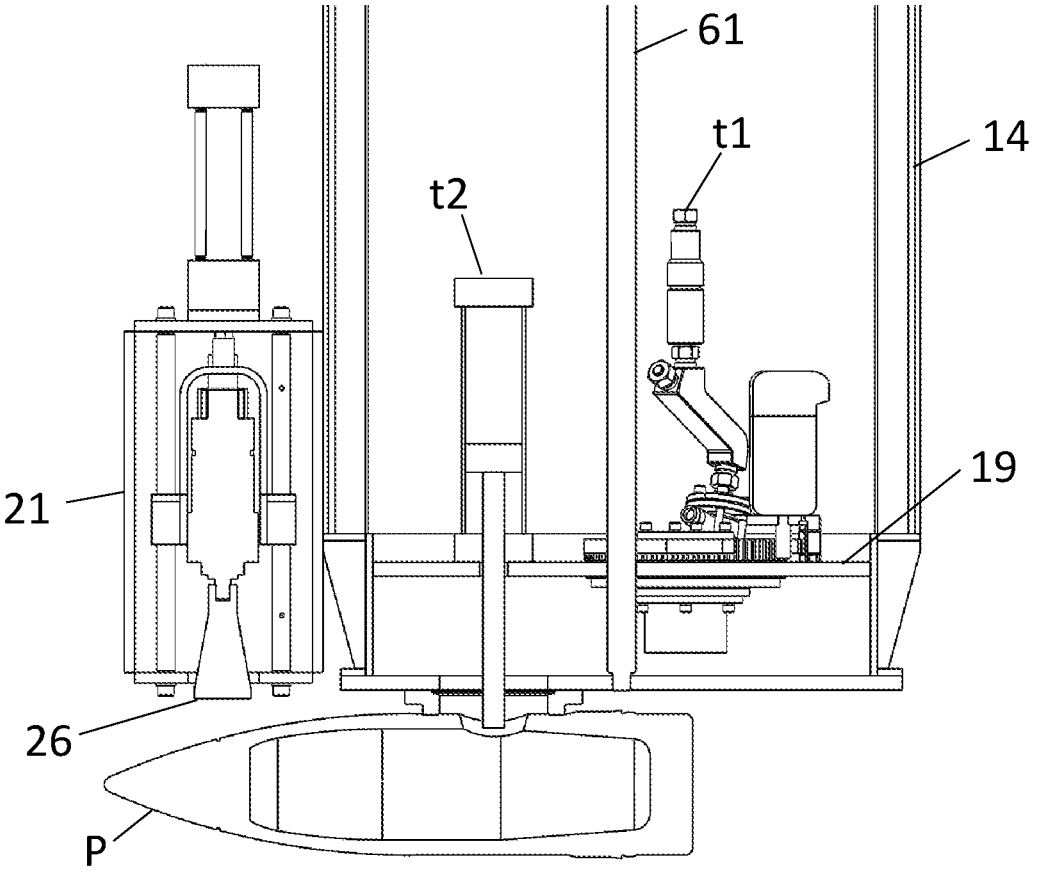
FIG. 6 hereof is a side view of the lower section of a tool package of the present invention showing the plug retrieval tool in an extended positioned attached to the plug to be retrieved, thereby leaving a cut-out hole in the casing of the targeted ordnance item.

FIG. 6 hereof is another view of the bottom section of the tool package hereof, but showing plug removal tool t2 in a extended position. After the plug has been cutout with waterjet cutting tool t1, the turntable is turned so that the plug removal tool t2 is positioned over the annual through-hole in base plate 20 where upon plug removal tool is lowered through the its annular through-hole in the turntable and the annular through-hole base plate 20 wherein it makes contact with the plug, which is lifted from the ordnance item casing to expose the internal material in the ordnance item.

Figure 7:
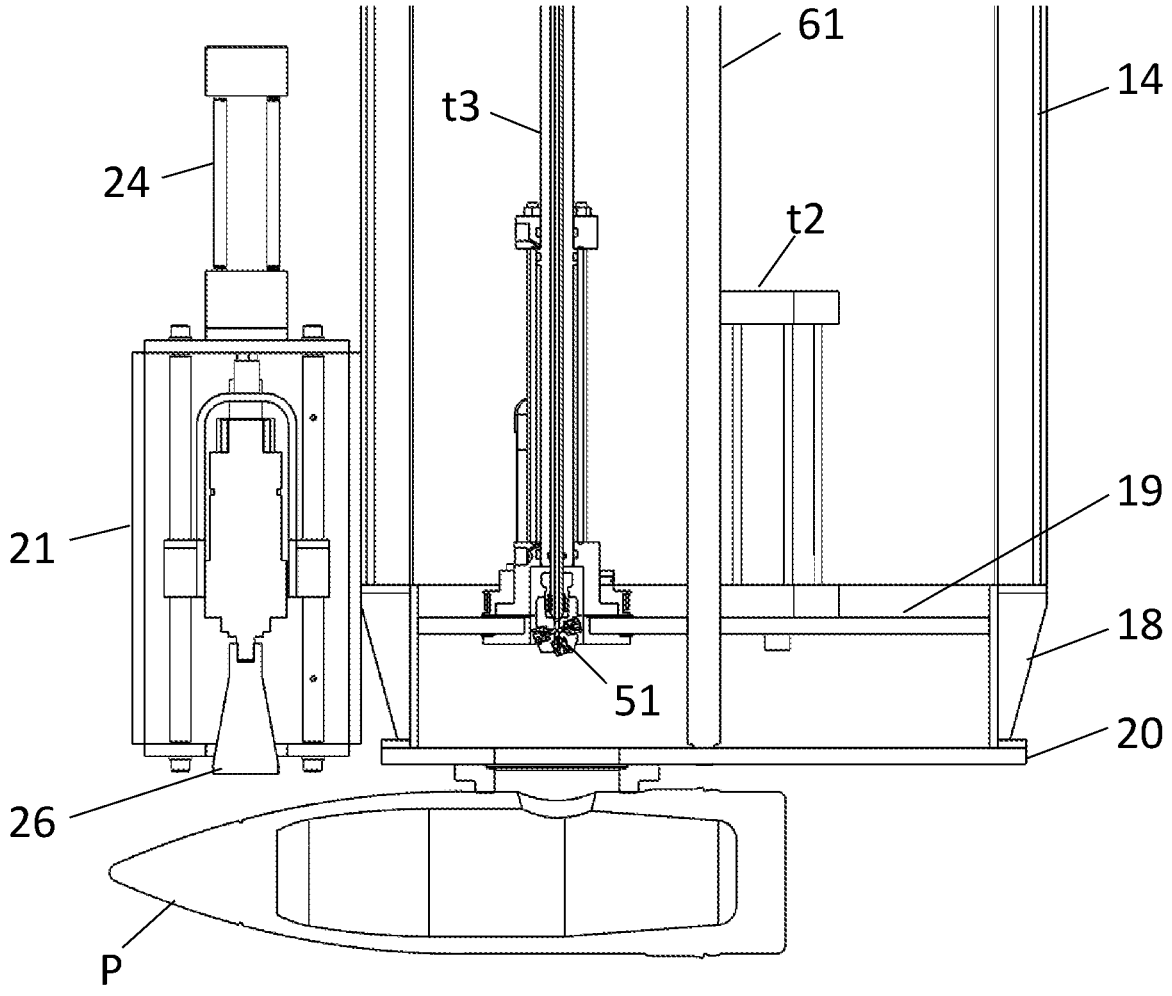
FIG. 7 hereof is a side view of the tool package of the present invention secured to a targeted ordnance item, but showing the washout tool partially extended toward to the cutout hole.

FIG. 7 hereof shows the stage where, after the plug is removed, the turntable is rotated so that the washout tool t3 is lowered through the two through-holes and into the interior of said ordnance item. Washout tool t3 contains at least one, preferably from 2 to 4 waterjet washout heads 51, which are operated at an effective high pressure that will result in washing out at least a portion, preferably all, of the internal material from the ordnance.

Figure 8:
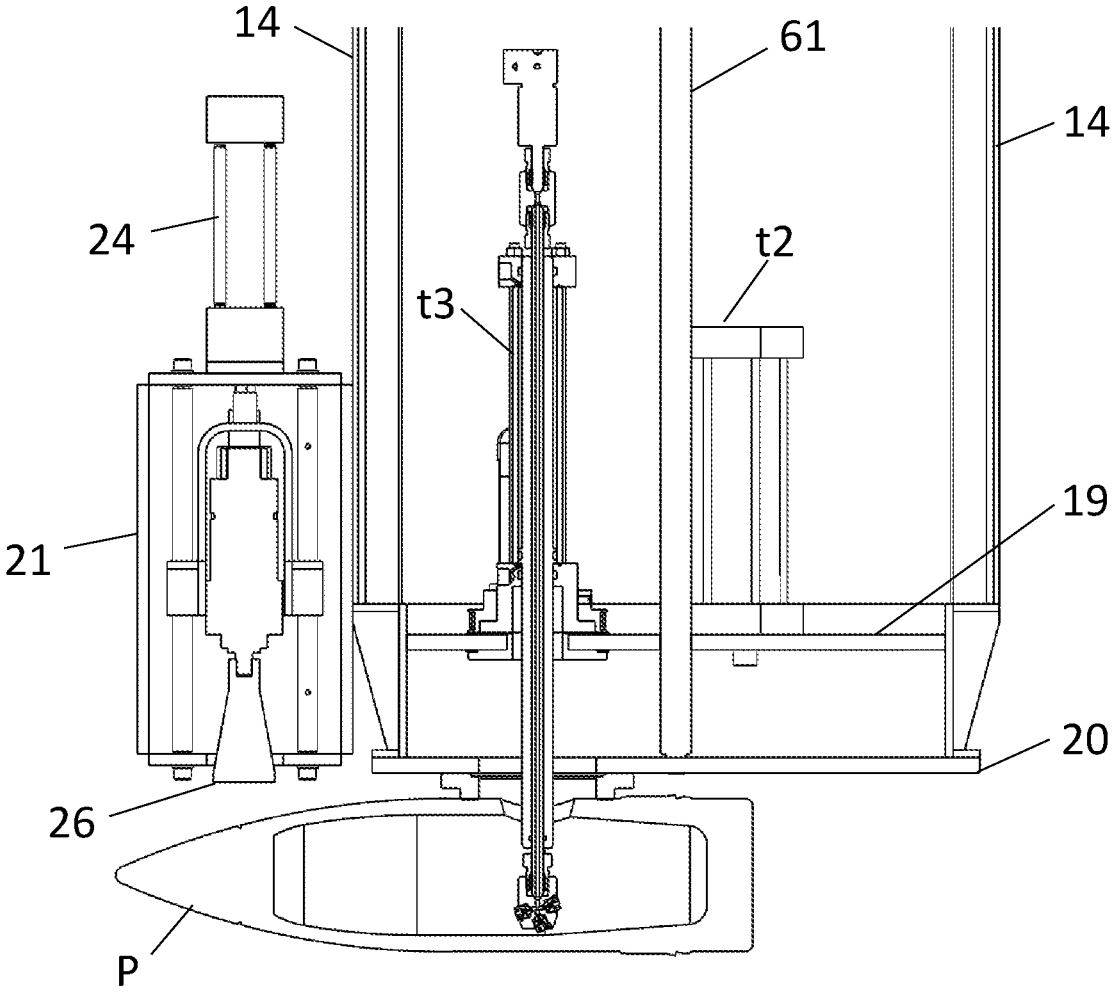
FIG. 8 hereof is a side view of a tool package of the present invention but showing the head of the washout tool fully extended into the cavity of the targeted ordnance item ready to be activated to washout and recover internal material from the targeted ordnance item.

FIG. 8 hereof is also a view of the lower section of the tool package of the present invention, but showing the showing the washout tool t3 extended into the interior of the ordnance item to washout internal material.

Collection of the washed-out internal material can be performed with the use of at least one pump, preferably with use of two pumps. One pump can be used for pulling liquid from a water storage tank through the ordnance item holding, or mating device and into a collection tank. The other pump can be used to pull liquid from the water storage tank through the volume between the bottom of the tool package and the turntable. This can also be pumped to a collection tank.

Waterjets are fast, flexible, reasonably precise, and have recently become relatively easy to use. They use the technology of high-pressure water being forced through a small hole (typically called the "orifice" or "jewel") to concentrate an extreme amount of energy through a small area. The restriction of the small orifice converts the high-pressure water into a high-velocity waterjet. The inlet (process) water for a pure waterjet is typically pressurized between 20,000 psi (138 MPa) and 150,000 psi (414 MPa). This is forced through the orifice, which is typically about 0.007" to 0.020" in diameter (0.18 to 0.4 mm) The result is a very high-velocity, very thin jet of water traveling in excess of the speed of sound in air.

Abrasive slurry waterjet, also known as an abrasive suspension jet, typically uses a hopper filled with abrasive, water, and a slurrying or suspension agent. This combined mixture is then pressurized and forced through the orifice of the cutting head. An abrasive slurry waterjet system must maintain the abrasive in suspension. This is typically done by the use of chemical additives and/or mechanical means, in order to prevent the abrasive from dropping out of suspension in the piping which can result in plugging and disabling of the system. Likewise, the flow of a pressurized abrasive and water slurry mix is highly erosive to piping, valves, and fittings used in the system. In addition, one or more large pressure vessels should be used to contain a sufficient amount of abrasive slurry for cutting. Consequently, an abrasive slurry waterjet system is typically limited in pressure to approximately 140 MPa, and normally operates at pressures closer to about 70 MPa.

Non-limiting examples of abrasive materials that are suitable for use in the present invention include glass, silica, alumina, silicon carbide aluminum-based materials, garnet, as well as elemental metal and metal alloy slags and grits. Preferred are garnet and aluminum-based materials. It is also preferred that the abrasive particles have either sharp edges or that they be capable of fracturing into pieces having sharp cutting edges, such as for example, octahedron or dodecahedron shaped particles. The size of the abrasive particles may be any suitable effective size. By effective size, is meant a size that will not plug the cutting head and that will be effective for removing the material of which the targeted object to be cut is made from (typically a metal alloy, such a steel) and which is effective for forming a substantially homogeneous mixture with the fluid carrier. Useful particle sizes for the abrasive material will range from about 3 mm to 55 microns, preferably from about 15 mm to 105 microns, and most preferably from about 125 microns to about 250 microns.

Abrasive entrainment waterjets use a high velocity waterjet, formed by pressurized water passing through an orifice (jewel) of the cutting head resulting in a partial vacuum in a mixing chamber downstream of the orifice that aspirates and entrains abrasive particles that are introduced into the mixing chamber. Although transport and delivery of abrasive particles is typically performed by vacuum aspiration, the abrasive transport can also be performed by pneumatic conveyance, or by a fluid conveyance as an abrasive suspension.

Abrasive entrainment waterjet technology has several advantages over abrasive slurry waterjet technology. For example, it is more reliable; it requires less maintenance; it is able to operate at internal system pressures up to about 1,000 MPa or more; it can operate in a continuous mode rather than in a batch mode; it doesn't require expensive chemical additives; and it is able to operate with significantly lower abrasive consumption.

The type of waterjet cutting head that is preferred for the practice of the practice of the present invention will be an abrasive entrainment waterjet cutting head that is generally comprised of: a metal body having an outer cylindrical surface and a central bore substantially parallel to the cylindrical surface, with an upstream direction and a downstream direction. It will have a jewel orifice mounted in the bore in the metal body. A portion of the central bore will typically be downstream of the jewel forming a mixing chamber. An inclined bore for abrasive material passes from the outer cylindrical surface to the central bore, preferably at an incline and joining the central bore downstream of the jewel at the mixing chamber. There is also typically provided a nozzle wherein the waterjet containing the abrasive further mixes and exits.

As previously mentioned, any type of waterjet pump can be used in the practice of the present invention as long as it is capable of delivering a jet of water, with entrained abrasive material, at a pressure of at least about 280 MPa to about 1000 MPa. A referred type of waterjet pumps suitable for use in the present invention is an intensifier pump. Waterjet intensifier pumps are well known in the art and utilize the so-called "intensification" principle. A waterjet intensifier pump typically operates by having pressurized hydraulic oil flow into one side of a centrally located hydraulic piston having double ended piston rods extending into the high pressure water cylinders at each end. The central hydraulic piston of the intensifier pump is typically 20 times the area of each piston rod giving a 20:1 intensification ratio. The piston rods, in turn, form the high pressure water pistons. Consequently, an application of 14 MPa hydraulic oil to the central hydraulic piston results in a twenty-fold intensification of pressure in the water cylinder and yields an outlet water pressure of 280 MPa. The outlet pressure of the water can be controlled by adjusting the inlet hydraulic oil pressure. When the centrally located hydraulic piston reaches the end of its stroke, a hydraulic valve body switches the flow of oil to the opposite side of the hydraulic piston and the process continues with the opposite water piston. The depressurized oil from the central cylinder is exhausted via the control valves to an exhaust port connected with an oil return to an oil reservoir.

What is claimed is:

1. A method for rendering safe an unexploded military ordnance item, which method comprises:

a) providing: i) a source of compressed air, ii) a source of hydraulic power, iii) a system for delivering abrasive material to a high pressure waterjet cutting head, iv) a source of electrical power, v) a source of fresh water, vi) a control system; and vii) an apparatus for deploying a tool package containing a plurality of tools for accessing and recovering internal material from said ordnance item;

b) locating an unexploded military ordnance item to render safe;

c) lowering a tool package into place above said targeted military ordnance item, which tool package containing a circular base plate having an annular through-hole of a size that will allow each tool of said tool package to reach through said through-hole to perform its intended work on a targeted military ordnance item under said through-hole, which circular base plate is supported by two legs, 180 degrees apart, and which legs, at their opposite ends are secured at opposite ends of a cross beam, which tool package contains a plurality of tools radially positioned about a moveable turntable wherein the tools of said tool package are positioned in an array about said turntable, and which turntable also contains an annular through-hole for each tool, which though-holes are of substantially the same size as the through-hole in said circular base plate, which tools including: i) a high pressure waterjet cutting tip capable of cutting a plug of casing out of said ordnance item; ii) a tool capable of removing said plug of casing material; iii) a waterjet head having at least one jet capable of delivering an effective jet of water at a pressure capable of washing out at least a portion of any material from the interior of said military ordnance item, which tool package, at its bottom contains a curved ordnance item holding structure having a radius of curvature substantially that of the targeted military ordnance item; and which tool package contains a waterjet cleaning head which is moved over the length of said ordnance item and activated to deliver a jet of water of sufficient pressure to remove any contaminant material, such as bioencrustacean growth on the surface of said ordnance item;

d) maneuvering said tool package over the targeted ordnance item so that the ordnance item holding device is directly over the targeted ordnance item;

e) lowering the tool package so that the ordnance item holding device makes contact with and secures said ordnance item;

f) rotating the turntable until the high-pressure abrasive waterjet cutting head tool is aligned with the annular through-hole in both the turntable and said circular base plate;

g) lowering the abrasive cutting head through said annular through-hole in said base plate to the surface of the casing of said targeted ordnance item, h) activating said abrasive waterjet cutting head and cutting a predetermined diameter plug out of the casing of said ordnance item;

i) deactivating said abrasive waterjet and raising the cutting head to its resting position;

j) rotating the turntable until the plug-removal tool is aligned with said annular through-hole of the circular base;

k) lowering said removal tool through the annular through-hole and removing the plug, thereby exposing the internal material within the ordnance item casing;

l) raising the plug removal tool to above said circular base;

m) rotating the turntable until the wash-out waterjet head is directly over the annular through-hole of the base plate; and n) lowering the waterjet wash-out head into the interior of said ordnance item and activating the washout waterjet and washing out and recovering at least a portion of the internal material from the interior of said ordnance item.

2. The method of claim 1 wherein a deployment system is used to position the tool package over a targeted ordnance item.

3. The method of claim 2 wherein the deployment system is a gantry capable of movement in all the x, y, and z planes.

4. The method of claim 1 wherein the internal material is an energetic material.

5. The method of claim 1 wherein the internal material is a chemical warfare material.

6. The method of claim 1 wherein the internal material is a bio-warfare material.

7. The method of claim 1 wherein the ordnance is a projectile.

8. The method of claim 1 wherein the casing of the ordnance item is an iron-based material.

9. The method of claim 8 wherein the plug removal tool has a magnetized tip.

* * * * *